US008109188B2

(12) United States Patent
Bellmunt-Molins et al.

(10) Patent No.: US 8,109,188 B2
(45) Date of Patent: Feb. 7, 2012

(54) MODIFIED SLICING SHOES AND METHOD FOR MAKING FOOD PRODUCT SHAVINGS

(75) Inventors: Santiago Bellmunt-Molins, Sant Cugat de Vallès (ES); Nieves Calvo-Frias, Burgos (ES); Juan Ignacio Corujo-Martinez, Cunit (ES)

(73) Assignee: Frito-Lay Trading Company GmbH, Berne (CH)

( * ) Notice: Subject to any disclaimer, the term of this patent is extended or adjusted under 35 U.S.C. 154(b) by 454 days.

(21) Appl. No.: 12/175,786

(22) Filed: Jul. 18, 2008

(65) Prior Publication Data

US 2010/0015312 A1 Jan. 21, 2010

(51) Int. Cl.
*B26D 3/28* (2006.01)

(52) U.S. Cl. ..... 83/403; 83/411.1; 426/144; 426/518

(58) Field of Classification Search ..... 83/403, 83/410.7, 410.9, 411.1, 411.2, 425.3, 698.11; 426/144, 518; 99/353
See application file for complete search history.

(56) References Cited

U.S. PATENT DOCUMENTS

| | | | | | |
|---|---|---|---|---|---|
| 2,195,879 | A | * | 4/1940 | Urschel et al. | 83/403 |
| 3,139,127 | A | * | 6/1964 | Urschel et al. | 83/161 |
| 4,523,503 | A | * | 6/1985 | Julian et al. | 83/403 |
| 4,590,835 | A | * | 5/1986 | Matsuo | 83/698.41 |
| 4,648,296 | A | | 3/1987 | Wisdom et al. | |
| 4,937,084 | A | * | 6/1990 | Julian | 426/144 |
| 4,945,794 | A | * | 8/1990 | Quo et al. | 83/13 |
| 5,095,875 | A | * | 3/1992 | Morris et al. | 83/856 |
| 5,097,735 | A | | 3/1992 | Mendenhall | |
| 5,211,098 | A | | 5/1993 | Mendenhall | |
| 5,694,824 | A | | 12/1997 | Jacko et al. | |
| 5,745,999 | A | * | 5/1998 | Zirkiev | 30/278 |
| 5,819,628 | A | * | 10/1998 | Cogan et al. | 83/698.11 |

FOREIGN PATENT DOCUMENTS

WO 2004/106015 A1 12/2004

OTHER PUBLICATIONS

WWW.URCSHEL.COM, Urschel® Model CC, Versatile Slicer, Shredder, & Granulator, L1987 Jun. 2005 (s.s. 1958) Valparaiso, Indiana.

* cited by examiner

*Primary Examiner* — Edward Landrum
(74) *Attorney, Agent, or Firm* — Colin P. Cahoon; Celina M. Orr; Carstens & Cahoon, LLP

(57) ABSTRACT

Modified slicing shoes and method for making food product shavings. A conventional slicing shoe for insertion into a slicing head assembly used in conjunction with a centrifugal type slicing machine is modified. The modified slicing shoes comprise a cutting edge having top and bottom ends that protrude towards the interior of a slicing head assembly as a vertex protrudes away from the interior such that the blade is not confined to one plane. In one embodiment, the slicing shoe blade cutting edge and its components comprise a V-shape having an angle that ranges from between about 90° to about 140°. In a second embodiment, the slicing shoe and its components are curvilinear having a curvature ranging from about 1.5 cm to about 2.0 cm. The shape of the blade and its corresponding components allow for the production of snack chips having folded or curled shapes.

17 Claims, 7 Drawing Sheets

MODIFIED SLICING SHOES AND METHOD FOR MAKING FOOD PRODUCT SHAVINGS

BACKGROUND OF THE INVENTION

1. Technical Field

The present invention relates to a modified food-slicing shoe for a slicing system that provides for the commercial production of folded or curly food snack chip products that resemble pencil shavings. A standard interchangeable food product slicing shoe and its blade are modified to produce shaped slices, which when fried provide a chip product with enhanced crunchiness and texture.

2. Description of Related Art

There are a number of methods for slicing food products as a pre-processing step to producing food products in the industry. Various machines and methods have been manufactured for the commercial production of ready-to-eat food products, such as potato or other vegetable or fruit chips, to produce chips of a variety of textures and sizes to appeal to the different preferences of consumers.

One such machine is a centrifugal type slicer, such as the one disclosed in U.S. Pat. No. 5,694,824 to Jacko et al., which is directed to "a cutting head for slicing a food product." Jacko et al. describes a slicing machine typically used to cut raw produce, usually in the form of whole potatoes, into slices to create, for example, potato chips. As seen in FIG. 1, depicting the prior art, potatoes are fed through a feed hopper 10 onto an impeller 14 with inwardly extending partitions, which is surrounded by a stationary slicing head assembly 12. A motor (not pictured) rotates the impeller 14 via a gear box 16, creating a centrifugal force that causes the potatoes to move outwardly against the partitions and the inner surface of the slicing head assembly. As further detailed in FIGS. 2 and 3, the slicing head assembly includes a series of slicing shoes with cutting blades 22 commonly referred to as slicing shoes. The slicing shoe consists of a casting 20 having a flat blade 22 attached with bolts 26. As the product passes by the cutting blades of the slicing shoes, potato slices are quickly produced and passed on through a chute 18 for further processing into a ready-to-eat potato snack chips.

A centrifugal slicing machine, such as the one disclosed in Jacko et al., is manufactured and sold by Urschel Laboratories, Inc of Valparaiso, Ind. These machines allow for the production of generally flat slices which may or may not contain some texture along the surface. For example, a flat blade produces a flat slice, while a blade having a number of waves or ridges along its cutting edge produces either a wavy or ridged chip, respectively. However, the blades currently used remain straight and elongated, confined to the same plane, producing generally flat potato slices.

Market studies have shown that consumers crave more variety in terms of shape. Specifically, studies show that consumers often desire the folded or curled shapes produced when products are sliced by hand. Consequently, there is a need for a method and apparatus for commercially production of snack chips having folded or curled shapes that more closely resemble hand-made chips, which are made by batch processes. Further, there is a need to provide nonplanar shapes, while utilizing currently available commercial equipment such as the centrifugal type slicing machines. There is also a need for a modified slicing shoe capable of providing more variety with regard to the shapes of ready-to-eat snack products. Accordingly, there is a need for modification of the straight (or flat) slicing head blades and their corresponding slicing shoes presently available.

SUMMARY OF THE INVENTION

The present invention provides a modified slicing shoe comprising a vertically concave shape along the interior of a slicing shoe facing a rotatable impeller. A blade secured to the front end of the slicing shoe conforms to (i.e. mirrors) the vertically concave shape of the slicing shoe, enabling the production of food products into folded or curled shapes that resemble pencil shavings. The vertically concave shaped knife blades and their corresponding slicing shoe castings comprise a vertex which forms a depression in the interior of the shoes along transverse plane of the shoe, as the top and bottom ends of the blade project inward towards an axis of rotation for the impeller. The matching shape of the interior of the casting provides support to the blade such that the centrifugal forces cause at least one food product to move into the depression to be subsequently sliced by the concave blade.

In a first embodiment, the vertically concave shape of the blade and interior surface of the slicing shoe comprises two knife blade edges which meet at a vertex point away from an impeller, forming an angular "V" shape. In a second embodiment, the vertically concave shape of the interior surface and blade of the slicing shoe is curvilinear such that the vertex is rounded, creating a trough-like shape on inside surface of the slicing shoe. Thus, the slicing shoe is able to create an angled or curved shaped slice which can intentionally fold or curl up on adjacent sides of the slice.

The present cutting system improves upon traditionally made batch snack food products with fewer product defects in a continuous process and at much higher production levels. The modified shoe slicing segments are formed to fit within a standard slicing head assembly such as one typically used in centrifugal slicing known in the industry for commercial production. The slicing head assembly surrounds a rotatable impeller with blades, which is caused to spin by a motor. Raw or whole produce is fed through a food product hopper onto the impeller and the centrifugal force then causes the food products to move away from the axis of rotation and towards the depression or vertex on the inner sides of the stationary slicing head assembly. The cutting edge of the blades having a vertex at a transverse plane of the assembly is then able to continuously cut shaped slices from the food product. The slices can then be further processed to reduce the moisture of the products, producing ready-to-eat snacks having folded or curled shapes.

Other aspects, embodiments and features of the invention will become apparent from the following detailed description of the invention when considered in conjunction with the accompanying drawings. The accompanying figures are schematic and are not intended to be drawn to scale. In the figures, each identical, or substantially similar component that is illustrated in various figures is represented by a single numeral or notation. For purposes of clarity, not every component is labeled in every figure. Nor is every component of each embodiment of the invention shown where illustration is not necessary to allow those of ordinary skill in the art to understand the invention.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

is a perspective, detailed view of a second embodiment of the modified slicing support segment and blade of the present invention.

Figure 7A:
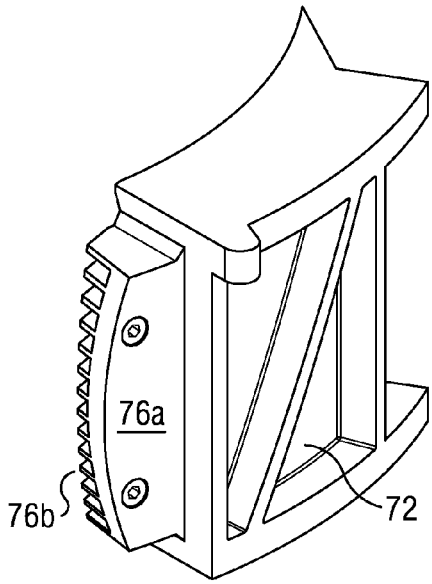

FIG. 7*a* is a perspective view of an exterior side featuring the curved sand gate portion of a second embodiment of the modified slicing shoe of the present invention.

Figure 7B:
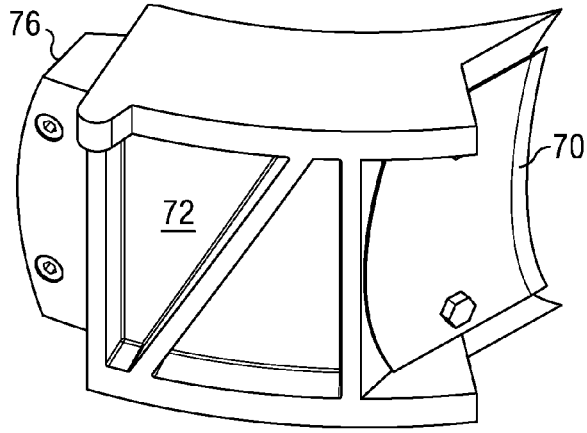

FIG. 7*b* is a frontal perspective view of an exterior side featuring the curved blade of a second embodiment of the modified slicing shoe of the present invention.

Figure 7C:
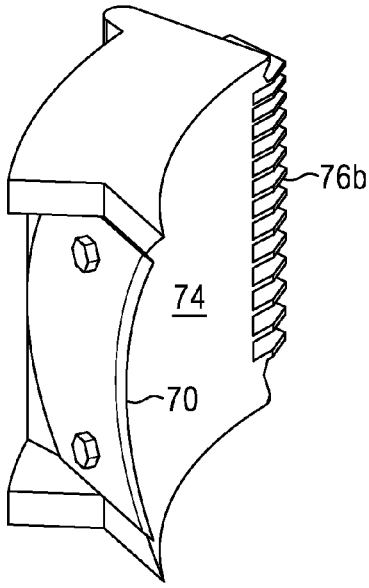

FIG. 7*c* is a perspective view of an interior side featuring the curved blade of a second embodiment of the modified slicing shoe of the present invention.

Figure 7D:
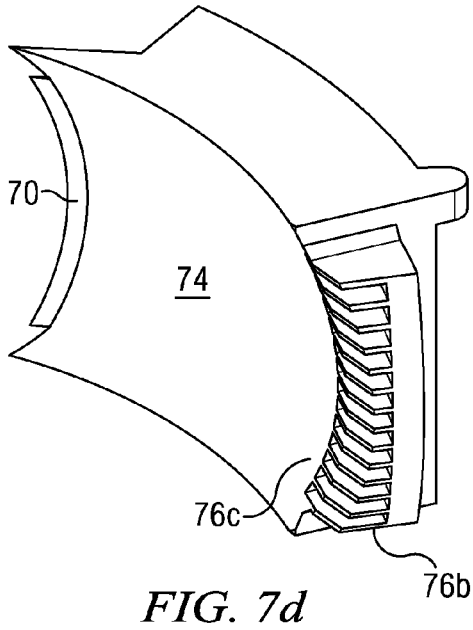

FIG. 7*d* is a perspective view of an interior side featuring the curved sand gate portion of a second embodiment of the modified slicing shoe of the present invention.

Figure 8:
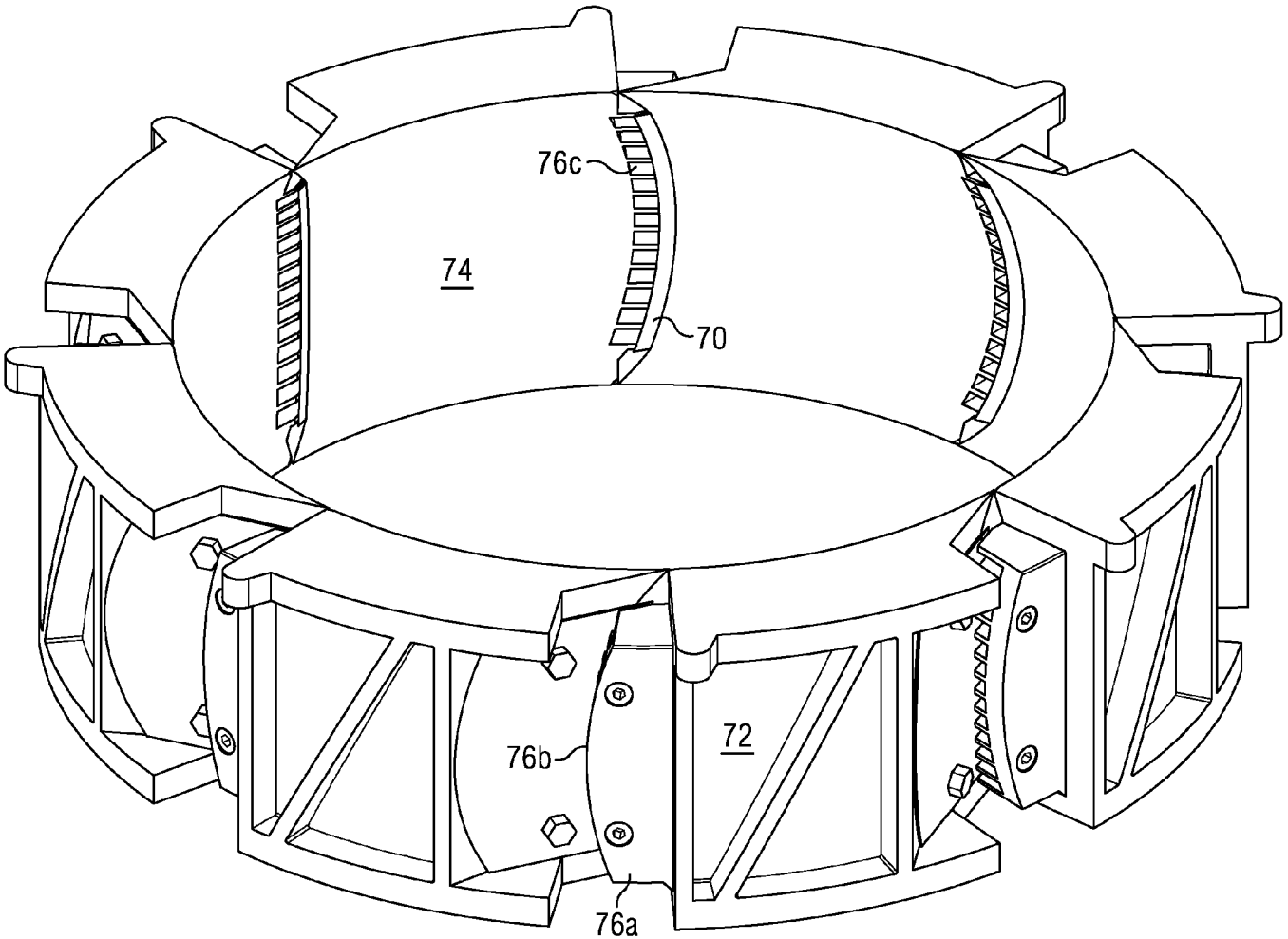

FIG. 8 illustrates a perspective view of a second embodiment of the modified slicing shoes of the present invention arranged generally cylindrically to produce a modified slicing head assembly of the present invention.

DETAILED DESCRIPTION

A known centrifugal slicer such as that manufactured as an Urschel Model CC is seen in FIGS. 1-4. Only those components necessary for an understanding of this invention will be described. The stationary slicing head assembly 12 comprises eight slicing shoes positioned in a generally cylindrical shape within which an impeller is rotatably mounted on a gear box 16 to be driven by a suitable driving means such as a motor (not shown). Product that enters through the feed hopper 10 is caused by the centrifugal forces of the rotation to move outwardly around the interior of the slicing head assembly 12, which comprises a plurality of slicing shoe support segments, each having a stationary slicing blade 22.

Figure 1:
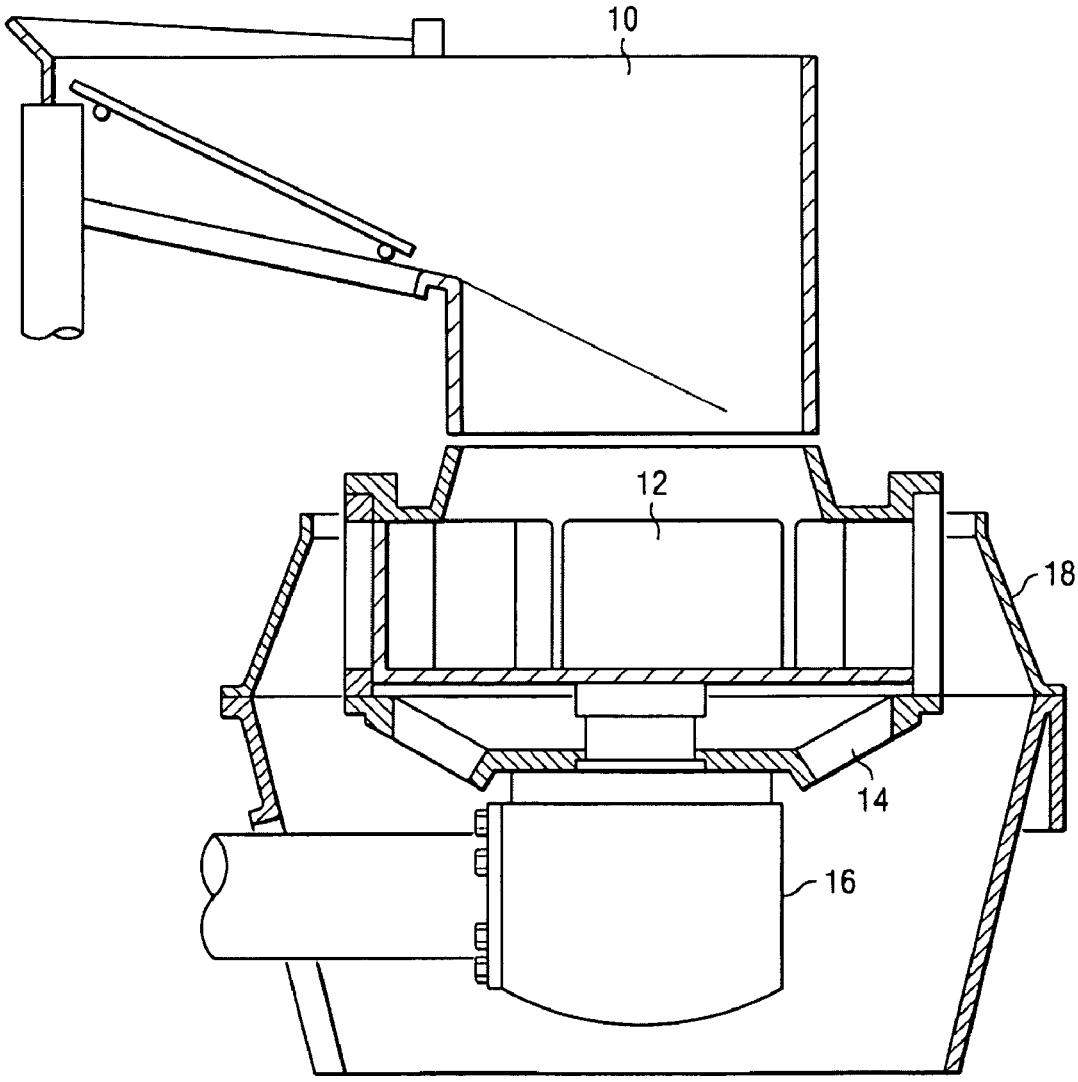
FIG. 1 (PRIOR ART)
FIG. 1 illustrates a partial side view of a known centrifugal slicing device with a prior art slicing head assembly.
Figure 2:
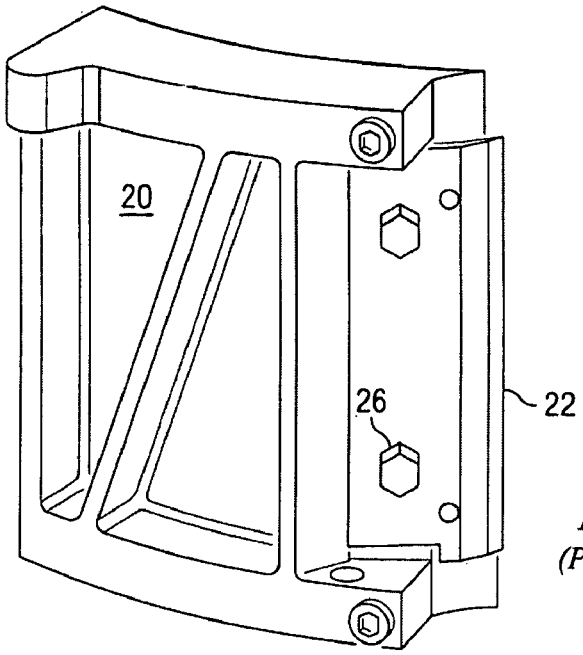
FIG. 2 (PRIOR ART)
FIG. 2 is a close-up view of a conventional slicing support segment and blade.
Figure 3:
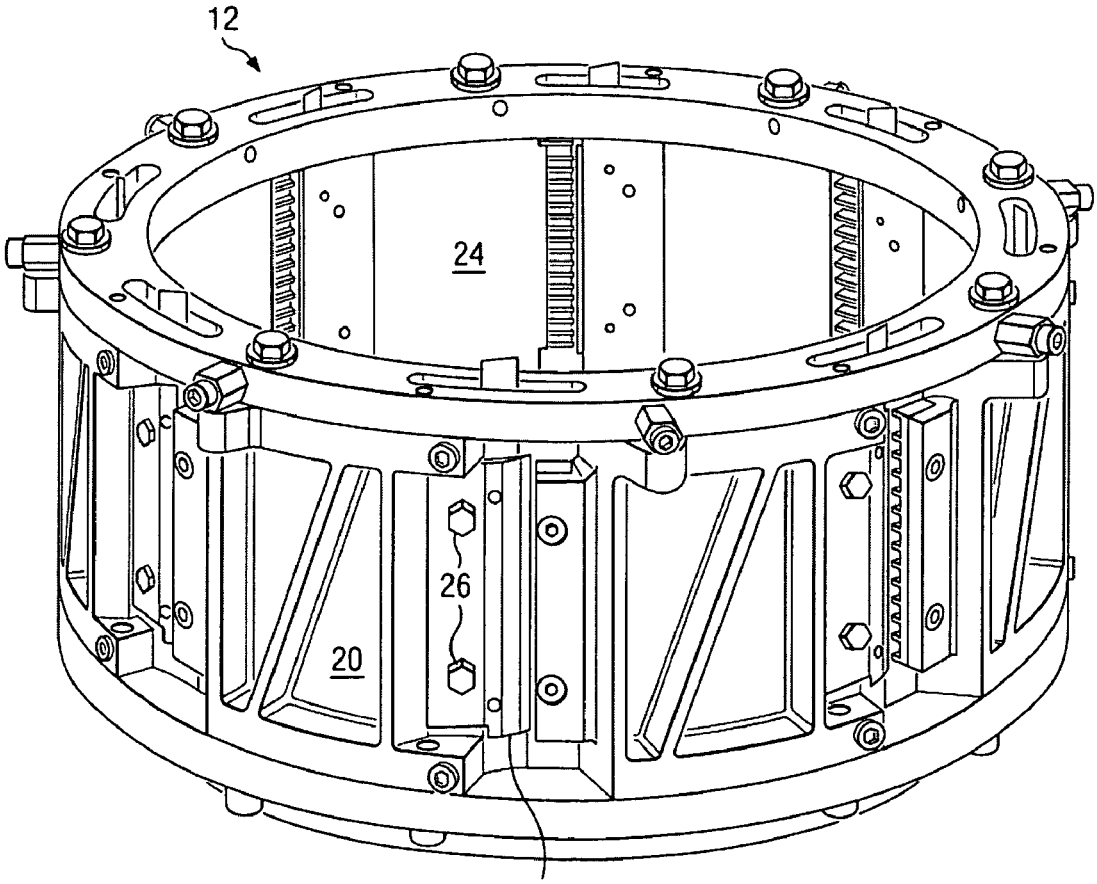
FIG. 3 (PRIOR ART)
FIG. 3 depicts perspective view of a prior art slicing head assembly.
Figure 4:
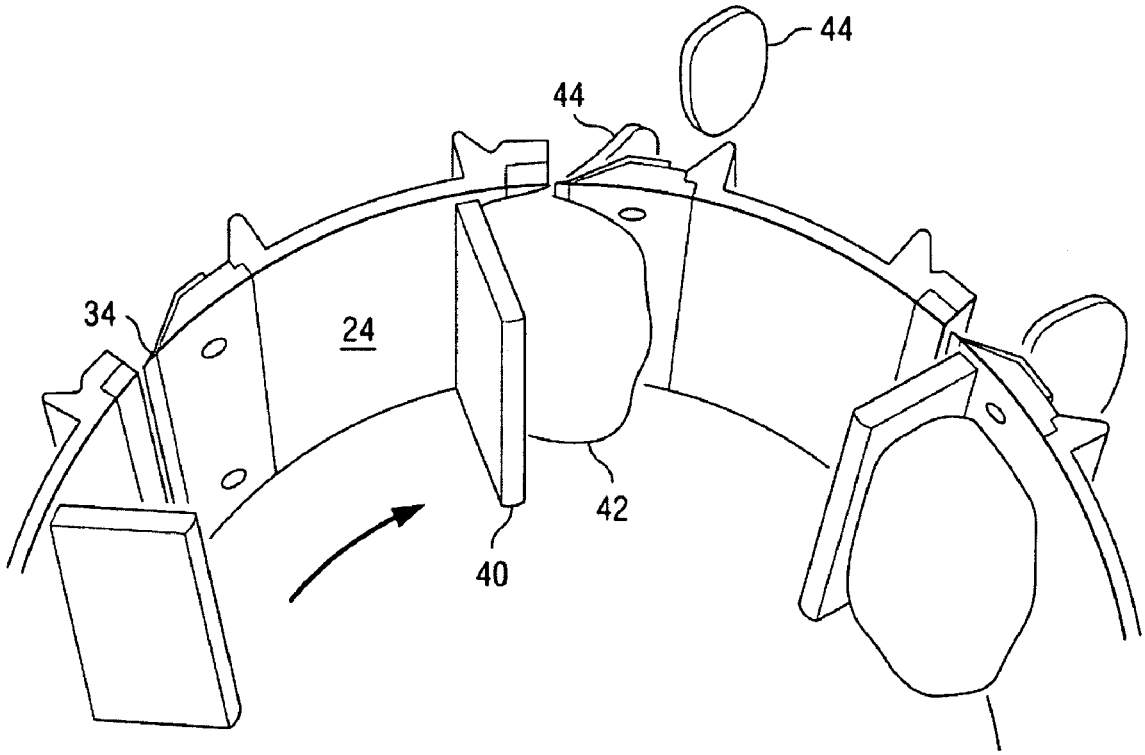
FIG. 4 (PRIOR ART)
FIG. 4 is a partial, perspective view demonstrating the known slicing of food products using a centrifugal slicing machine.
Figure 5A:
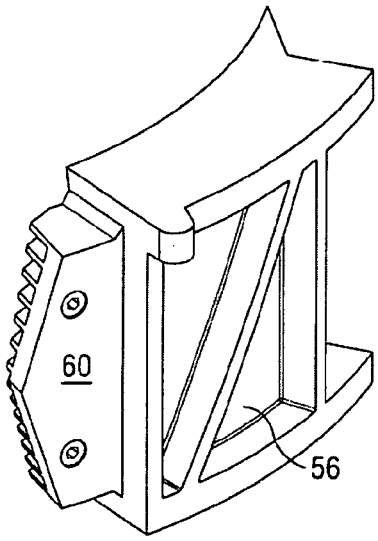
FIG. 5*a* is a perspective view of an exterior side featuring the angled sand gate portion of a first embodiment of the modified slicing shoe of the present invention.
Figure 5B:
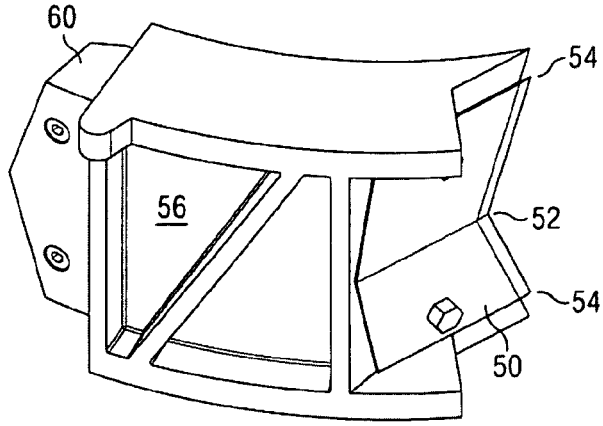
FIG. 5*b* is a frontal perspective view of an exterior side featuring the angled blade of a first embodiment of the modified slicing shoe of the present invention.
Figure 5C:
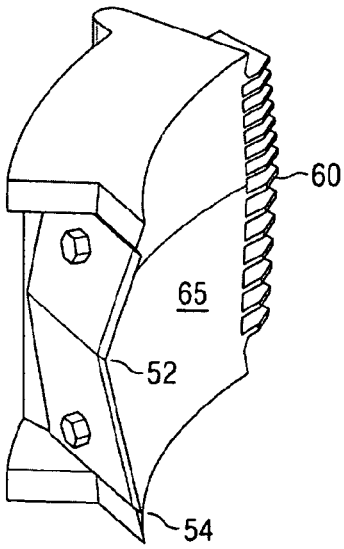
FIG. 5*c* is a perspective view of an interior side featuring the angled blade of a first embodiment of the modified slicing shoe of the present invention.
Figure 5D:
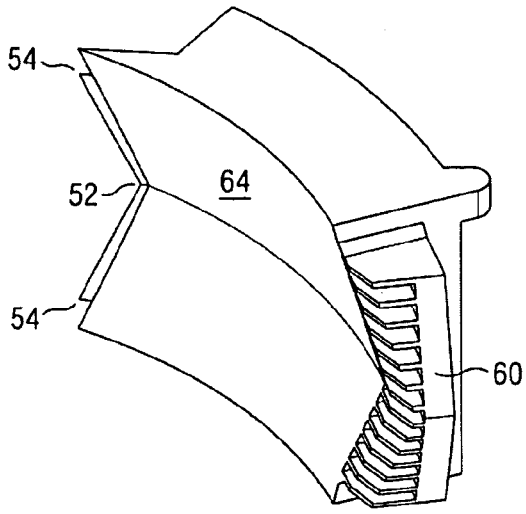
FIG. 5*d* is a perspective view of an interior side featuring the angled sand gate portion of a first embodiment of the modified slicing shoe of the present invention.

As shown in FIGS. 2 and 3, each blade 22 is generally straight, having edges that fall within the same plane. Each straight blade 22 is attached at a front end of the casting 20 by means of bolts 26. A sand gate also having a straight edge is attached at a rear end of the casting 20 to trap sand, dirt and other kinds of debris. Referring to FIG. 4, the impeller 40 rotates in the direction of the arrow, causing food product 42 to move against the flat interior walls 24, causing the straight blades 22 to create flat slices 44.

Applicants use the term "pencil shavings" or "shavings" interchangeably to refer to the shapes achieved and typically discarded when sharpening a pencil such that the resulting food product slicings are coiled, twisted or folded, thereby having surfaces which are not confined to only one plane. As used herein, "folded" is meant to refer to having at least two sides come into contact with one another. When cooked by means such as frying or baking, these food product shavings produced by the slicing shoes of the present invention result in ready-to-eat food products with an enhanced crunchy texture similar to hand-made chip products. Food products suitable for use with the present invention include without limitation potatoes, apples, pears, beets, yucca, sweet potato, mangos, eggplant, cucumber, zucchini, etc.

The modified slicing shoe of the present invention comprising a distinct arcuate shape is designed for use together with a centrifugal-type Urschel slicing system as disclosed above. In one embodiment, the slicing shoes and assembly of the present invention are utilized to conform to the G2 Urschel system. A knife blade, removably secured to a first end of each slicing shoe, comprises a cutting edge with top and bottom ends that protrude inward towards the impeller. Further, a vertex in the cutting edge of the blade protrudes away from the impeller to form a vertically concave shape in relation to the axis of rotation of the rotatable impeller. The vertex at the center of the blade is concave relative to the axis of rotation of the impeller such that the blade is symmetrical with regard to the central transverse plane. Consequently, the cutting edge vertex is contained within a vertical plane outside that of a parallel vertical plane containing the top and bottom protruding ends, forming a bent (or curved) blade not confined to only one plane. The vertex forms a depression in the interior of each slicing shoe and at a transverse plane of the stationary assembly. To support the concave shape of the blade and the centrifugal force caused by the rotating impeller, the casting of the slicing shoe comprises a matching concave shape such that the blades are properly supported and the food product is drawn towards the transverse plane of the modified slicing shoes and assembly. The modified slicing shoes are interchangeably situated in a generally cylindrical modified stationary assembly around a rotatable impeller. The assembly thus comprises a plurality of the modified slicing shoes, with a first end of each shoe positioned adjacent to a second end of a juxtaposed slicing shoe.

To protect the assembly and blades from debris, a sand gate containing wells for trapping debris is also shaped for use with the modified slicing shoe. The sand gate secured at a second end of the casting also conforms to the vertically concave shape of the blade such that, upon aligning the slicing shoe segments around a generally circular array, a second end of a slicing shoe lines up correctly with a first end of an adjacent slicing shoe segment so as to define a food slicing opening or gap, the size of which determining the thickness of the food slice. The cutting edges of the blades are exposed to the rotatable impeller at these openings such that as food passes by the openings, food shavings are achieved in a continuous and uninterrupted manner. In addition to having a vertically concave shape with a vertex in the interior of the sand gate facing the impeller, the sand gate also comprises a corresponding convex shape along its trailing end such that the edge of the blade and interior of the assembly is further protected. The sand gate may be removable attached or integral to the slicing shoe.

As used herein, the term "vertex" refers to both the vertex of an angle as well as the vertex of a curve. The "vertex" of the shaped blade edge includes the point where two planes or blade edge sides intersect and the local extreme point of a curvature or curve. The "vertex" of the slicing shoe that conforms to the blade comprises an area on the inner surface of the slicing shoe that protrudes away from the impeller, while the surrounding top and bottom end portions of the shoe protrude towards the impeller, resulting in a trough-like depression along an interior side of the slicing shoe intersected by a transverse plane of both the individual slicing shoes as well as the assembly.

FIGS. 5-8 depict two embodiments of the slicing shoes and assemblies of the present invention. In FIGS. 5*a*-*d*, the vertically concave interior surface comprised of top and bottom halves 64, 65 of the casting 56 and cutting edge shape of the knife blade 50 are angular such that said vertex 52 is at a point where two knife blade edges meet and protrude towards the exterior side of the slicing shoe and away from the impeller. The vertex lies within a central transverse plane of the modified shoe (as well as the assembly created by an arrangement of a plurality of shoes). In contrast, the top and bottom ends 54 of the blade cutting edge protrude away from the exterior side of the slicing shoe and towards the impeller to form a V-shape. As shown in FIG. 5*c*, the blade comprises a concave-convex surface such that the outside surface of the blade is convex at the exterior of the blade. The interior of the casting of the slicing shoe conforms to the shape of the blade as depicted in FIG. 5*d*. The sand gate 60 attached at a second end of the slicing shoe also has an interior surface that parallels the angle of the blade. Further, the sand gate comprises a corresponding convex V shape on the trailing edge of the sand gate to better protect the assembly from debris. The angle or "V" formed by the two knife blade edges can be modified depending on the type of folded slice desired. Thus, the concavity of the interior surface of the casting shoe and knife blade ranges from about 75 degrees to about 155 degrees, more preferably 80 degrees to about 150 degrees, and most preferably from about 90 degrees to about 140 degrees. When varying the angle, the slicing shoe components are modified accordingly to conform to and support the angular dimension of the blade 50 and to support the centrifugal forces caused by the rotating impeller and to confine the food products within the inner walls (i.e., interior) of the slicing head assembly for slicing. As seen in FIG. 5*d*, the inner surface of the casting contains the vertex and a depression along the transverse plane of the shoe, while supporting the angled knife blades. The top half 64 of the vertically concave interior surface of the casting slopes outward from the impeller towards a vertex, forming a trough or depression, and meets with the bottom half 65 of the vertically concave interior surface of the casting which slopes back inward towards the impeller, mirroring the top half 64 of the shoe.

The blade 50 can be secured to the casting by any means known in the art including but not limited to screws or bolts having flat heads which fit through openings in a knife blade clamp (not pictured) rigidly attaching the angular blade 50 to the front, exterior side of the casting 56. A knife blade holder can also hold the blade in place along the interior side of the blade. One skilled in the art, armed with this disclosure will appreciate that any components used to removably secure the blade and sand gate to the casting will conform to the concave shape of the interior.

Figure 6:
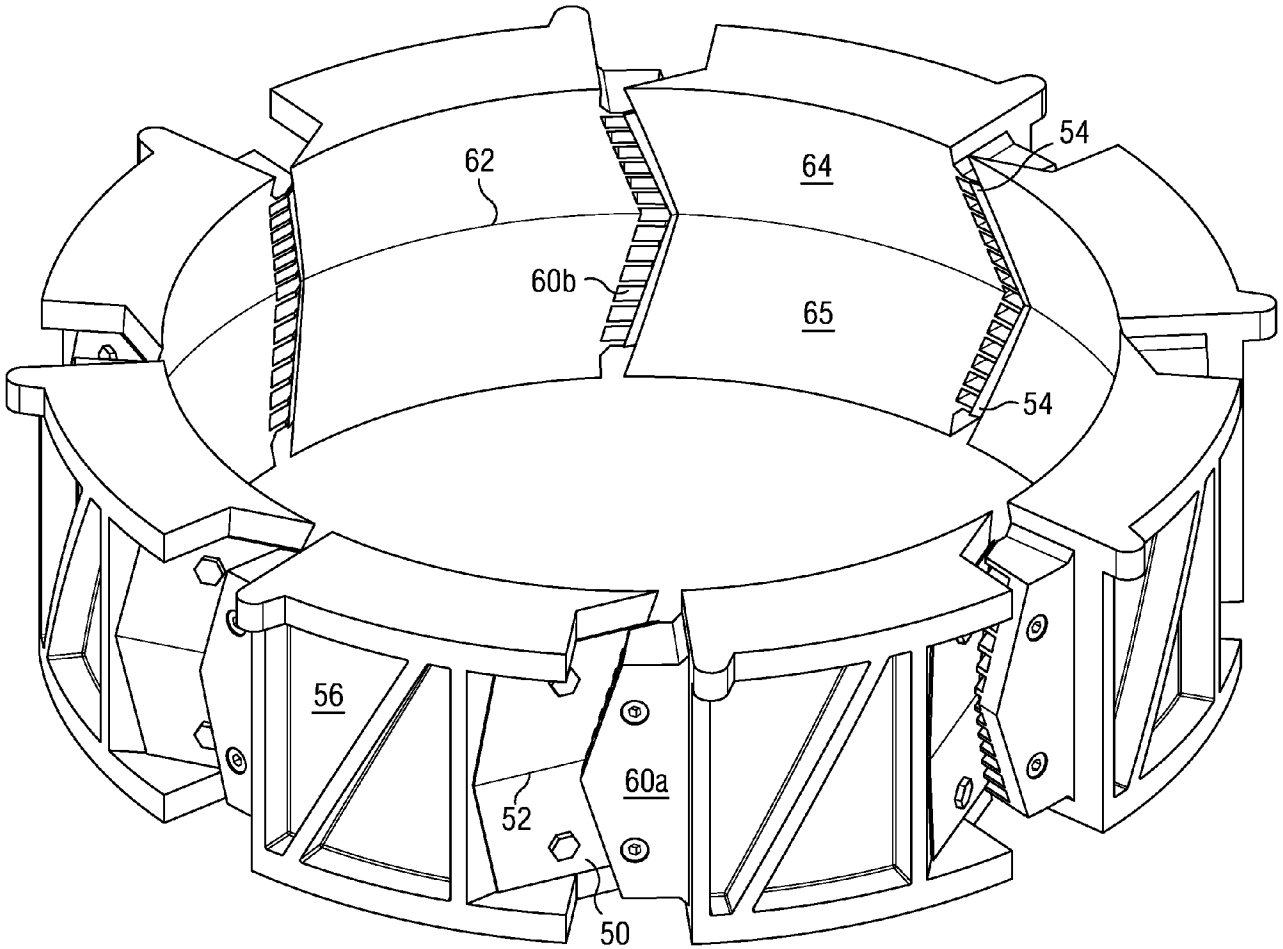
FIG. 6 illustrates a perspective view of a first embodiment of the modified slicing shoes of the present invention arranged generally cylindrically to produce a modified slicing head assembly of the present invention.

The modified slicing shoes of a first embodiment are arranged in spaced relation to one another to form a generally cylindrical shape for placement around a rotatable impeller of a centrifugal-type slicing machine having an axis of rotation as shown in FIG. 6. A first end of each slicing shoe having a knife blade 50 with a cutting edge is positioned adjacent to a second end of a juxtaposed slicing shoe, which comprises a sand gate 60 to protect the assembly. The interior of the assembly depicts a back perspective 60*b* of the sand gate, as the front perspective 60*a* is also illustrated to show the trailing convex point of the sand gate. Each of the knife blades has top and bottom ends that point inwards, protruding towards the impeller, in addition to a vertex 52 protruding away from said impeller, forming a vertically concave interior surface relative to the axis of rotation such that the surface of the casting of each slicing shoe parallels and supports the vertically concave interior surface of said knife blade. Consequently, the assembly comprises an arcuate interior surface having a vertically concave shape relative to an axis of rotation of said impeller. To create further variation of sizes and shapes, two or more blades having different angles within the indicated range can also be used with the corresponding components matching the chosen angles to form the stationary slicing head assembly.

FIGS. 7*a*-*d* depict a second embodiment of the present invention, wherein the blade 70 takes on a curvilinear shape that can vary in terms of curvature (i.e., width and depth). The vertically concave interior surface 74 of the casting and the cutting edge shape of the knife blade are curvilinear, having a vertex at a point furthest away from the impeller intersecting a central transverse plane. The vertex at the center of the blade is concave relative to the axis of rotation of the impeller such that the blade forms a semi-circular or parabolic shape, symmetrical with regard to the transverse plane. To quantify the depth of the concave surface for the curvilinear blade, a curvature distance is measured. The curvature distance is the distance between the vertex of the blade and a vertical plane, which intersects the top and bottom ends of the blade and which is parallel to the axis of rotation. The curvature can range from about 1.0 cm to about 2.5 cm, more preferably from about 1.25 cm to about 2.25 cm, and most preferably from about 1.5 cm to about 2.0 cm. However defined the curvature of the blade 50, the slicing shoe components should also conform to the shape of the blade to support a parallel curvilinear blade of the slicing shoe. As explained above, the removably attached sand gate also comprises a concave shape conforming to the shape of said knife blade and said casting, wherein said sand gate is secured to a second end of the slicing shoe.

Similar to the angular blade discussed above, the curvilinear blade 70 can be secured to the casting by any means known in the art including but not limited to screws or bolts having flat heads which fit through openings in a knife blade clamp (not pictured) rigidly attach the curvilinear blade 70 to the front, exterior side 72 of the casting. A flat head is preferred so that the bolts will not interfere with the ejected slices as they pass through the opening between the blade cutting edge on a first end of one shoe and the adjacent sand gate on a second end of a juxtaposed shoe. A knife blade holder (not pictured) conforming to the vertically concave shape and vertex can also hold the blade in place along the interior side of the blade. As seen in FIG. 7*a*, the trailing end 76*b* of the sand gate 76 comprises a curvilinear convex arch shape relative to an adjacent slicing shoe. As shown in FIG. 7*d*, depicting the interior side 76*c* of the sand gate 76, the surface of the sand gate facing the impeller conforms to the curvilinear shape of the casting and curvilinear cutting edge 70.

FIG. 8 depicts a plurality of the second embodiment of the modified slicing shoes arranged in spaced relation to form a generally cylindrical shape for placement around a rotatable impeller of a centrifugal-type slicing machine having an axis of rotation. A first end of each slicing shoe having a curvilinear knife blade 70 with a cutting edge is positioned adjacent to a second end of a juxtaposed slicing shoe, which comprises the curvilinear sand gate 76 to protect the assembly. The interior of the assembly depicts a back perspective (i.e., interior side) 76*c* of the curvilinear sand gate 76, as the front perspective 76*a* is also illustrated to show the trailing convex curvilinear shaped arch of the trailing end 76*b* of the sand gate. Each of the knife blades has top and bottom ends that point inwards, protruding towards the impeller, in addition to a vertex at the centered transverse plane of the assembly protruding away from an impeller, forming a vertically concave interior surface 74 relative to the axis of rotation such that the surface of the casting of each parallels and supports the vertically concave shape of said curvilinear knife blade. Again, the assembly comprises an arcuate interior surface having a vertically concave shape relative to the axis of rotation of said impeller. To create further variation of sizes and shapes, two or more blades having different curvatures, widths and depths within the indicated range can also be used with the corresponding components matching the chosen arcs to form the stationary slicing head assembly. As food product passes by the opening between the first end (blade) 70 of the support segment and the second end (sand gate) 76, food product shavings are continuously achieved. Further variation of food products sizes and shapes can be achieved by using two or more semi-circular blades of different curvatures around the impeller. As the impeller is caused to rotate, the novel blades and the corresponding shoes will continuously produce distinctly-shaped food products not confined to only one plane that can be processed into ready-to-eat snacks having shapes resembling shavings.

The modified slicing shoes and assembly provide for a modified method of slicing food product with a centrifugal-type slicing machine. At least one food product is inserted into said impeller, which is caused to rotate such that the at least one food product is forced away from the axis of rotation due to centrifugal forces. The food product moves towards the vertically concave interior wall surface of the castings of said slicing shoe. The food product is finally sliced by the specialized cutting edges of the knife blades attached to the castings of the shoe.

It is to be understood that the angle or curvature of one or more blades in a slicing head assembly can vary according to desired shape or type of food product used. Further, any combination of the novel blades can be used around the slicing head assembly to maximize the number of shapes achieved.

Unless otherwise indicated, all numbers expressing angles, curvatures and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

Having thus described several aspects of at least two embodiments of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A modified slicing shoe having first and second ends for use with a centrifugal-type slicer having an impeller for the production of food products having folded or curled shapes, said slicing shoe comprising:

a) a knife blade with a smooth cutting edge having top and bottom ends which protrude towards the impeller, said cutting edge consisting of a single vertex at a central transverse plane of the knife blade protruding away from said impeller, forming a vertically concave shape, said knife blade further comprising an interior surface and an exterior surface; and b) a casting having a vertically concave interior surface, wherein said interior surface of said knife blade comprises a curvature matching a curvature of said interior surface of the casting, and wherein said knife blade is secured to a first end of said casting; and c) a sand gate secured to a second end of the casting, said sand gate having an interior concave surface matching the exterior surface of the blade.

2. The slicing shoe of claim 1 wherein the vertically concave interior surface of said casting and said knife blade are curvilinear.

3. The slicing shoe of claim 2 wherein said curvilinear blade has a curvature ranging from about 1.5 cm to about 2.0 cm.

4. The slicing shoe of claim 1 wherein said vertically concave interior surface of said casting and said knife blade are angular such that said vertex is at a point where two knife blade edges meet.

5. The slicing shoe of claim 4 wherein said two knife blade edges form a V-shape comprising an angle of between about 90 degrees and about 140 degrees.

6. The slicing shoe of claim 1 wherein said sand gate further comprises a convex trailing end having a curvilinear arch shape.

7. The slicing shoe of claim 1 further comprising a knife blade holder securing said knife blade to said casting.

8. The slicing shoe of claim 1 wherein said knife blade is secured to an exterior side of said casting.

9. The slicing shoe of claim 1 wherein said vertex is contained within a vertical plane outside of a parallel vertical plane having the top and bottom protruding ends of the knife blade.

10. A modified stationary slicing head assembly for use with a centrifugal slicing machine, the slicing head assembly having a plurality of modified slicing shoes arranged in a generally cylindrical arrangement around an impeller having an axis of rotation, wherein a first end of each slicing shoe is positioned adjacent to a second end of a juxtaposed slicing shoe, said modified stationary slicing head assembly comprising:

a) a plurality of knife blades, each of which having a smooth cutting edge with top and bottom ends which protrude towards the impeller, said cutting edge consisting of a single vertex at a central transverse plane of the knife blade protruding away from said impeller, forming a vertically concave shape in relation to the axis of rotation, and wherein each of said knife blades is secured to the first end of said slicing shoe and wherein each of said knife blades further comprises an interior surface and an exterior surface;

b) an arcuate interior surface having a vertically concave shape relative to the axis of rotation of said impeller; and c) a plurality of castings, each of which having a vertically concave interior surface, said vertically concave interior surface comprising a curvature that matches the curvature of the knife blades and wherein each of said knife blades is attached to a first end of each of said castings;

d) a plurality of sand gates, each of which is secured to a second end of each of said castings, wherein each of said sand gates comprises an interior concave surface matching the exterior surface of each of said knife blades, and further wherein a gap is maintained between each of said knife blades and each of said sand gates of a juxtaposed slicing shoe.

11. A method for making food product shavings using a centrifugal type slicing machine having an impeller with an axis of rotation surrounded by a plurality of slicing shoes arranged in a generally cylindrical shape to form a stationary slicing head assembly, wherein each of said slicing shoes has a casting with a knife blade secured to a first end of said casting, said method comprising the steps of:

a) inserting at least one food product into said impeller;

b) causing said impeller to rotate such that the at least one food product is forced away from the axis of rotation and towards the castings of said slicing shoes, wherein each of said castings has a vertically concave interior surface relative to said axis of rotation; and c) slicing said at least one food product with a smooth cutting edge of said knife blade, wherein the cutting edge has top and bottom ends which protrude towards the impeller and consists of a single vertex at a central transverse plane of the knife blade protruding away from said impeller, forming a vertically concave interior shape that matches the curvature of the vertically concave interior surface of each of said castings, thereby producing folded or curly snack food chip products.

12. The method of claim 11 wherein said vertically concave interior surface of said casting and said knife blade are curvilinear.

13. The method of claim 12 wherein said curvilinear blade has a curvature ranging from about 1.5 cm to about 2.0 cm.

14. The method of claim 11 wherein said vertically concave interior surface of said casting and said knife blade are angular such that said vertex is at a point where two knife blade edges meet.

15. The slicing shoe of claim 14 wherein said blade having at least two edges forms a V-shape comprising an angle of between approximately 90 degrees and 140 degrees.

16. The method of claim 11 further comprising a sand gate having a concave interior surface that matches the interior surface of said casting and the angle of said knife blade, wherein said sand gate is secured to a second end of the casting.

17. The method of claim 11 further comprising a knife blade holder securing said knife blade to said casting.

* * * * *